United States Patent [19]

Kuebler

[11] Patent Number: 5,000,452

[45] Date of Patent: Mar. 19, 1991

[54] TENNIS RACKET, HANDLE CAP, AND HANDLE GRIP WRAPPING

[76] Inventor: Siegfried Kuebler, Mozartstraße 17, D-7770 Überlingen, Fed. Rep. of Germany

[21] Appl. No.: 390,988

[22] Filed: Aug. 9, 1989

[30] Foreign Application Priority Data

Aug. 29, 1988 [DE] Fed. Rep. of Germany ..... 3829231

[51] Int. Cl.[5] ..... A63B 49/08

[52] U.S. Cl. ..... 273/73 J; 273/75; 273/81.5

[58] Field of Search ..... 273/73 R, 73 J, 75, 273/81 R, 81 D, 81.5, 81.6

[56] References Cited

U.S. PATENT DOCUMENTS

| | | | |
|---|---|---|---|
| 1,943,399 | 1/1934 | Smith | 273/81.5 |
| 3,606,325 | 9/1971 | Lamkin | 273/75 |
| 4,101,125 | 7/1978 | Heath | 273/73 J |

*Primary Examiner*—Benjamin Layno
*Attorney, Agent, or Firm*—Bachman & LaPointe

[57] ABSTRACT

A racket with a handle for ball games, in particular a tennis racket, with a head frame surrounding a stringing arrangement, an open throat region adjoining the head frame, and a handle cap which terminates the handle towards the end thereof and which approximately bears with a cap edge against a shaped handle portion and with same is wrapped around by a strip-like portion of grip material is to be improved in such a way that the wrapping leather or grip material can be easily fixed in position and reliably held in place. For that purpose the handle cap (26) has a clamping gap (28) for receiving the free end (26$_e$) of the strip, and in addition the clamping gap (38) is directed approximately parallel to a surface (33) of the cap edge (32), one side surface (33) of which has a prong-like portion (41) formed thereon, which with the side surface delimits the clamping gap (38).

9 Claims, 1 Drawing Sheet

Figures 1, 2, 3, 4, 5, 6, 7:
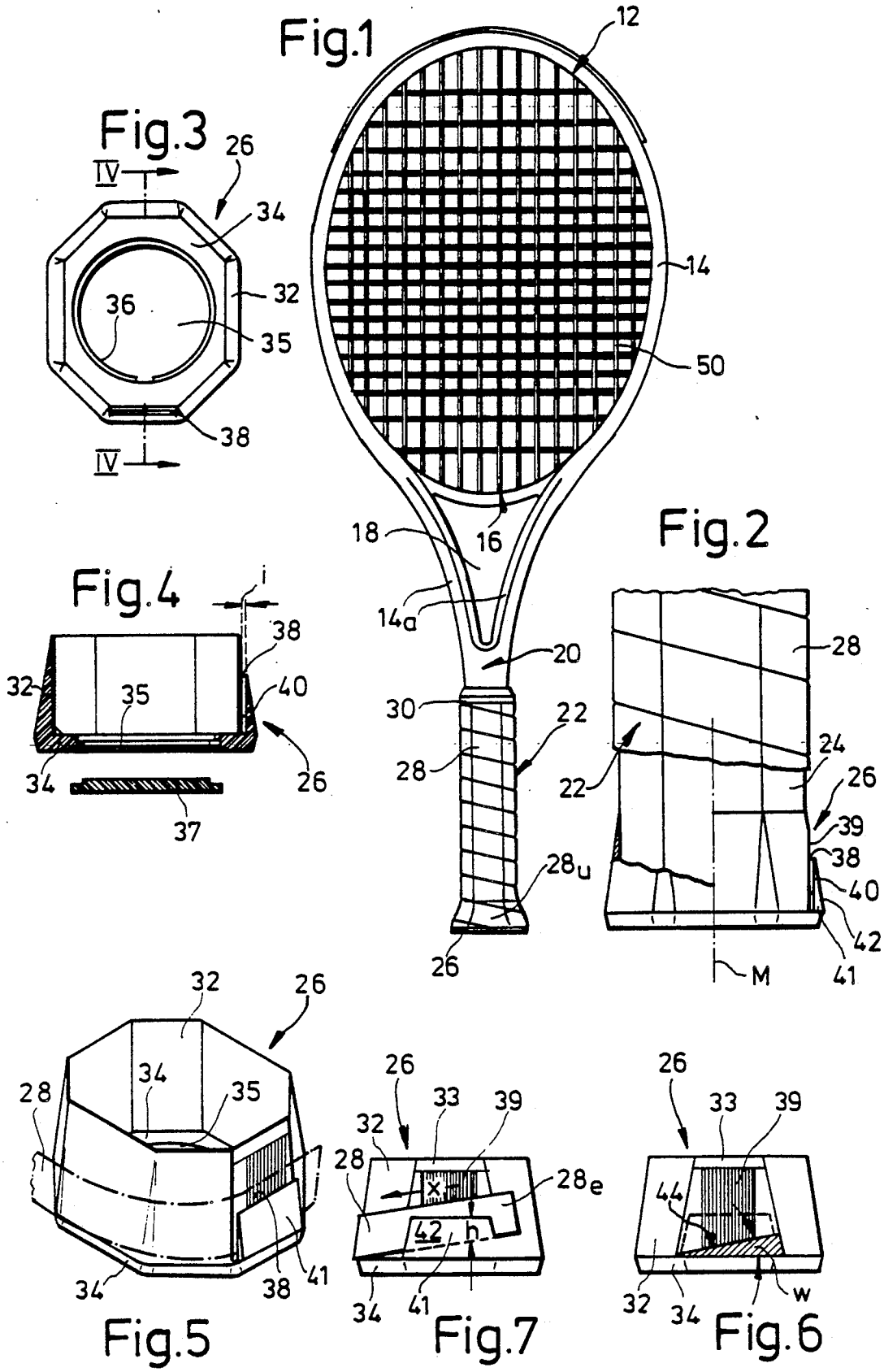

12
14
50
16
18
14a
20
30
22
28
28u
26

28
24
22
26
39
38
40
42
41
M

26
IV
34
32
36
35
38
IV i
38
32
35
40
34
26
37
32
26
28
34
35
34
38
41

26
33
39
32
28
28e
x
42
h
34
41

26
33
39
44
32
34
w

TENNIS RACKET, HANDLE CAP, AND HANDLE GRIP WRAPPING

The invention relates to a racket with a handle for ball games, in particular a tennis racket, with a head frame surrounding a stringing arrangement, an open throat region adjoining the head frame, and a handle cap which terminates the handle towards the end thereof and which approximately bears with a cap edge against a shaped handle portion and with same is wrapped around by a strip-like portion of grip material, wherein a free end of the strip of the grip material is fixed adjacent the end of the handle.

A tennis racket of that kind is known from, German utility model No. 84 27 999. The portion of strip material which is in the form of a wrapping leather strip is usually fixed with the free end of the strip to the handle cap or the shaped handle portion by means of a nail or the like. It has been found in practice that an arrangement of that kind is too time-consuming and the fixing is generally still insufficient.

Having regard to those considerations the inventor set himself the aim of so improving a racket of the kind set forth in the opening part of this specification that the grip leather or portion of strip material can be simply fixed and reliably held in position.

To attain that object, the handle cap has a clamping gap for receiving the free end of the strip and the clamping gap is directed approximately parallel to a surface of the cap edge. In addition a side surface of the cap edge is to be provided with a prong-like portion formed thereon, which with said side surface defines the clamping gap.

In that way it is possible for the end of the portion of strip material to be inserted from above into the clamping gap without any additional fixing operation being involved. Particularly when, in accordance with a further feature of the invention, the width of the clamping gap approximately corresponds to the thickness of the end of the strip, the end of the strip is readily held in fixed position and can then be wound in a helical configuration around the shaped handle portion in the usual manner.

A feature of particular significance in regard to the operability of the handle cap is the feature that the prong-like portion is disposed within the contour of the handle cap or the cap edge so that the wrapping leather strip does not have any raised bump portion of any kind whatever.

The retention of the end of the strip material in the clamping gap is improved by the side surface and/or the inside surface of the prong-like portion being knurled or grooved.

An aid to fitting the grip material is the feature that the height of the clamping gap decreases towards the free end of the strip, and in particular the clamping gap is of such a configuration that the bottom thereof extends inclinedly at an angle relative to the free end of the handle cap. The end of the strip material is fitted with one longitudinal edge thereof against the bottom of the clamping gap and is thus directed in precisely the direction in which it extends to the free end of the handle cap; when the wrapping leather strip reaches the free end of the handle cap, the actual operation of wrapping the leather in a helical configuration around the handle begins. A portion of the wrapping leather than also covers the free end of the strip.

Further advantages, features and details of the invention will be apparent from the following description of a preferred embodiment and with reference to the drawings in which:

FIG. 1 is a plan view of a tennis racket with a handle having a leather strip wrapped therearound, FIG. 2 is a view on an enlarged scale of part of the FIG. 1 racket with an exposed handle cap, FIG. 3 is a plan view of the handle cap on a larger scale than FIG. 1, FIG. 4 is a view in section through FIG. 3 taken along line IV—IV therein, FIG. 5 is a perspective view of the handle cap, FIG. 6 is a partly sectional side view of the handle cap, and FIG. 7 shows the handle cap with one end of the leather strip for wrapping around the handle.

A tennis racket 10 has an oval head frame 12 which is formed by a correspondingly curved hollow shaped bar portion 14 which extends on both sides of the longitudinal axis of the racket, which forms an axis of symmetry M, and a further frame portion 16 which co-operates with the bar portion 14 to define the oval configuration. Strings 50 in a mesh-like intersecting arrangement are carried in the head frame 12.

Reference numeral $14_a$ shows two parts of the bar portion 14, which come together on the axis of symmetry M. With the parts $14_a$, the frame portion 16 defines an open throat region 18 which is adjoined by a short racket shaft 20. The shaft 20 goes into a handle 22. The handle 22 is made up of a shaped hollow portion 24 which extends the racket shaft 20 and a handle cap 26 which is pushed on to the shaped portion 24 and with same is covered by a common wrapping leather strip 28.

The wrapping leather strip 28 is held in clamped relationship with its free end $28_e$ in the handle cap and is then wrapped in a helical configuration around the shaped portion 24, as shown in FIGS. 1 and 2. The end of the wrapping leather strip 28 is then covered by a strip of adhesive material 30, towards the throat region 18.

The handle cap 26 comprises a cap edge 32 which is polygonal in plan view and which corresponds to the cross-section of the hollow shaped portion 24. As shown in FIG. 4, the cross-section of the cap edge 32 increases in width in a downward direction and goes into an end plate portion 34 formed thereon. The end plate portion 34 is provided with a round opening 35 which is surrounded by a spring lip 36. The spring lip 36 facilitates the operation of fixedly clamping in position an insert plate member 37 which is therefore releasably fixed in place and which can carry symbols of different kinds.

Arranged at one side surface 33 of the cap edge 32 is a clamping gap 38 of a width i of 1 mm, which is delimited on the one hand by a clamping surface 39 of the side surface 33, the clamping surface 39 extending approximately at a right angle to the bottom plate portion 34, and on the other hand by the inside surface 40 of a prong-like or tooth-like projection 41. The outside surface 42 of the projection 41 lies in the contour of the handle cap 26.

In the illustrated embodiment the clamping surface 39 is knurled or grooved parallel to the axis of symmetry M. That prevents the free end $28_e$ of the wrapping leather strip 28, which is inserted in the manner shown in FIG. 7, being pulled out of position, in the winding direction indicated by x.

In particular FIG. 6 shows that the bottom surface 44 of the clamping gap 38 extends inclinedly in the winding direction x so that the height h of the clamping gap 38 increases in the winding direction x. The angle w formed by the bottom plate portion 34 and the bottom surface 44 of the clamping gap 38 determines the direction in which the free end $28_e$ of the wrapping leather strip 28 extends. That end, together with the tooth-like projection 41, is covered over by the region of the wrapping leather strip 28 identified by $28_u$ in FIG. 1, and is thus additionally held clamped in position.

I claim:

1. A racket with a handle for ball games, which comprises: a head frame; a stringing arrangement surrounded by the head frame; a throat region adjacent the head frame; a handle adjacent the throat having a shaped handle portion and a handle end; a handle cap which terminates the handle towards the handle end and having a cap edge which bears against the shaped handle portion and having a cap edge side surface; a strip-like grip material having a free end which wraps around said handle and handle cap, wherein the free end is fixed adjacent the handle end; wherein said handle cap includes a clamping member which forms a clamping gap with said cap edge side surface, wherein said gap defines a clamping surface for receiving the free end of the strip and wherein the clamping gap is directed approximately parallel to the side surface of the cap edge.

2. A racket according to claim 1 wherein said clamping surface includes means to retain the free end therein.

3. A racket according to claim 1 wherein said clamping member is a prong-like portion of said handle cap which with the cap edge side surface delimits the clamping gap.

4. A racket according to claim 3 wherein the width of the clamping gap approximately corresponds to the thickness of the free end of the strip.

5. A racket according to claim 3 wherein the prong-like portion extends in the contour of the handle cap.

6. A racket according to claim 3 wherein said handle cap includes an end plate, wherein the cap edge increases in cross-section towards the end plate and wherein the prong-like portion is fitted in the thick base part of the cap edge.

7. A racket as set forth in claim 3 wherein a surface selected from the group consisting of the cap edge side surface, the inside surface of the prong-like portion and both the side surface and the inside surface of the prong-like portion are grooved or knurled.

8. A racket with a handle for ball games, which comprises: a head frame; a stringing arrangement surrounded by the head frame; a throat region adjacent the head frame; a handle adjacent the throat having a shaped handle portion and a handle end; a handle cap which terminates the handle towards the handle end and having a cap edge which bears against the shaped handle portion and having a cap edge side surface; a strip-like grip material having a free end which wraps around said handle and handle cap, wherein the free end is fixed adjacent the handle end; wherein said handle cap includes a clamping member which forms a clamping gap with said cap edge side surface, wherein said gap defines a clamping surface for receiving the free end of the strip and wherein said handle cap includes means for forming a clamping gap defining a clamping surface for receiving the free end of the strip and the clamping gap is directed approximately parallel to the side surface of the cap edge, and wherein the height of the clamping gap decreases towards the free end of the strip.

9. A racket according to claim 8 wherein the handle cap includes an end plate and wherein the clamping gap includes a bottom which extends inclinedly at an angle relative to the end plate of the handle cap.

* * * * *